US008231440B2

(12) United States Patent
LaMarche

(10) Patent No.: US 8,231,440 B2
(45) Date of Patent: Jul. 31, 2012

(54) EXPANSIBLE SANDING BLOCK EXHIBITING OBLIQUE EXTENDING SURFACES

(76) Inventor: Paul LaMarche, Rochester Hills, MI (US)

( * ) Notice: Subject to any disclaimer, the term of this patent is extended or adjusted under 35 U.S.C. 154(b) by 0 days.

(21) Appl. No.: 13/077,081

(22) Filed: Mar. 31, 2011

(65) Prior Publication Data

US 2011/0177766 A1 Jul. 21, 2011

Related U.S. Application Data

(63) Continuation-in-part of application No. 11/734,614, filed on Apr. 12, 2007, now Pat. No. 8,011,998.

(51) Int. Cl.
*B24D 17/00* (2006.01)

(52) U.S. Cl. ..... 451/495; 451/456; 451/504; 451/513; 451/514; 451/517; 451/523

(58) Field of Classification Search ..... 451/456, 451/495, 504, 512, 513, 514, 517, 523, 524
See application file for complete search history.

(56) References Cited

U.S. PATENT DOCUMENTS

| | | | |
|---|---|---|---|
| 1,947,054 | A | 2/1934 | McReynolds |
| 2,457,045 | A | 12/1948 | Kitterman |
| 2,761,257 | A | 9/1956 | Mendelsohn |
| 3,106,806 | A | 10/1963 | Hutchins |
| 3,429,078 | A | 2/1969 | Beckering |
| 3,601,933 | A | 8/1971 | Bowen |
| 3,699,729 | A | 10/1972 | Garvey et al. |
| 4,062,152 | A | 12/1977 | Mehrer |
| 4,242,843 | A | 1/1981 | Phillips |
| 4,334,390 | A | 6/1982 | Sumerau |
| 4,478,011 | A | 10/1984 | Russell |
| 4,525,959 | A | 7/1985 | Ziebarth et al. |
| 4,680,895 | A | 7/1987 | Roestenberg |
| 4,688,356 | A | 8/1987 | Madzgalla |
| 4,694,616 | A | 9/1987 | Lindberg |
| 4,730,430 | A | 3/1988 | Petrovich |
| 5,172,524 | A | 12/1992 | Poss |
| 5,283,988 | A | 2/1994 | Brown |
| 5,383,308 | A | 1/1995 | Beloff et al. |
| 5,387,251 | A | 2/1995 | Rouse |
| 5,474,490 | A | 12/1995 | Allport |
| 5,605,500 | A | 2/1997 | Matechuk |
| 5,720,654 | A | 2/1998 | Mac Donald |
| 6,053,805 | A | 4/2000 | Sanchez |
| 6,196,909 | B1 | 3/2001 | Cadrobbi |
| 6,213,857 | B1 | 4/2001 | Duquette |

(Continued)

FOREIGN PATENT DOCUMENTS

JP 01-129068 9/1989

*Primary Examiner* — Eileen P. Morgan
(74) *Attorney, Agent, or Firm* — Gifford, Krass, Sprinkle, Anderson & Citkowski, P.C.

(57) ABSTRACT

A sanding block for supporting an exteriorly mounted looped sanding belt having an elongated and planar shaped base. A planar shaped cover exhibits first and second oblique extending surfaces and, upon engaging with the base by a plurality of mating tabs and slots, collectively defines a three-dimensional article for supporting thereupon the looped sanding belt. A trigger exhibits a three-dimensional rectangular shape and extends laterally across a widthwise defined opening in the base in communicating fashion with an end surface associated with the cover, such that the trigger is positioned between the base and cover. The trigger is displaced in a first lateral direction to lengthwise displace the cover away from the base, the trigger displacing in a second and opposite lateral direction to reverse displace the cover inwardly towards the base.

15 Claims, 15 Drawing Sheets

U.S. PATENT DOCUMENTS

| | | | |
|---|---|---|---|
| 6,419,569 | B1 | 7/2002 | Frech et al. |
| 6,663,479 | B2 | 12/2003 | Sendelbeck |
| 6,682,400 | B2 | 1/2004 | Draper |
| 6,755,727 | B1 | 6/2004 | Bjerkhoel |
| 6,835,124 | B2 | 12/2004 | Stephan |
| 7,018,280 | B2 | 3/2006 | Walker |
| 7,025,667 | B1 | 4/2006 | LaMarche |
| 7,419,423 | B1 | 9/2008 | Reeves, Sr. |
| 2001/0007813 | A1 | 7/2001 | Cadrobbi |
| 2002/0111127 | A1 | 8/2002 | Tseng |
| 2004/0152405 | A1 | 8/2004 | Stephan |
| 2005/0079810 | A1 | 4/2005 | Melvin et al. |
| 2005/0272356 | A1 | 12/2005 | Walker et al. |
| 2005/0272357 | A1 | 12/2005 | Walker |
| 2006/0264161 | A1 | 11/2006 | Schnell et al. |

EXPANSIBLE SANDING BLOCK EXHIBITING OBLIQUE EXTENDING SURFACES

CROSS REFERENCE TO RELATED APPLICATIONS

This application is a continuation-in-part of U.S. patent application Ser. No. 11/734,614 filed Apr. 12, 2007 for an EXPANSIBLE SANDING BLOCK EXHIBITING OBLIQUE EXTENDING SURFACES.

FIELD OF THE INVENTION

The present invention relates generally to a hand-held sanding block design. More specifically, the present invention teaches an improved sanding block design exhibiting oblique extending surfaces. The sanding block incorporates a two-piece construction in which the respective upper (cover) and lower (base or bottom) halves are capable of being axially expanded or contracted in bidirectional fashion.

A key component is pivotally supported at an interior location of the upper assembleable halves and includes a trigger component which is accessible through a lengthwise slot defined in the upper halve. A window is defined in an upwardly projecting inner rail associated with the lower assembleable and linearly displaceable halve, through which extends a body portion of the key between its inner pivotal mounting location and outer engageable trigger.

Upon being pivotally actuated in a first contracting direction, in which the trigger is grasped and rotated outwardly from the body along the linearly edge defined slot, a first inner bend location associated with the key body engages a first edge defining shoulder associated with the window to inwardly/linearly collapse the lower halve relative to the upper halve and so as to reduce a collectively defined outer circumference associated with the sanding block to permit lateral removal of an outer supported sanding belt. Reverse rotation of the trigger results in an outwardly bent edge defined at a generally opposite side of the trigger body engaging a second edge defining shoulder of the window, further rotation of the trigger to return it to the flush position relative to the sanding block body resulting in respective halves expanding outwardly to the maximum displaced position to tension a replacement positioned sanding belt.

DESCRIPTION OF THE PRIOR ART

The prior art is well documented with various examples of hand-held sanding block designs. The objective of such sanding blocks is the ability to selectively grip or loosen an exteriorly mounted sanding belt for any desired sanding application associated with wood, plastics, gypsum board and the like A first example of a sanding block drawn from the prior art is set forth in U.S. Pat. No. 6,196,909, issued to Cadrobbi, and which teaches an abrading tool exhibiting an abrasive belt loosely wrapped about an elongated block. A tension adjuster is inserted between the belt and the block, the belt tension being adjusted by sliding the tension adjuster lengthwise either towards or away from the end of the block. An alternate variant includes a lengthwise extending slot defined in a base block, and within which is secured a mounting block to secure the abrasive sheet to the base block.

U.S. Pat. No. 5,387,251, issued to Rouse, teaches an endless belt sanding block, exhibiting four flat rigid support sections connected by a set of hinges in order to form a closed loop. First and second tapered supports are folded inwardly at the junction of their thickened ends, and in order to contract the assembly to permit the installation or removal of an overlaying sanding belt. A brace section is located inside the foldable loop and connects to the same hinge and in order to form a triple hinge to maintain the endless sanding belt taut and ready for use.

U.S. Pat. No. 5,720,654, issued to Mac Donald, teaches a hand sanding block for use with an endless abrasive belt of the type normally used with power sanders. The block exhibits a body and a slidable nose which is biased outwardly. A pin limits the outward travel of the nose relative to the body. A detent is provided so that nose may be temporarily secured in a retracted position for ease of loading and unloading sanding belts.

SUMMARY OF THE INVENTION

The present invention discloses a novel and improved sanding block incorporating first and second assembleable halves defining multiple and oblique extending surfaces. Typically, a base component exhibits a planar shape and to which is slidably interengaged a cover exhibiting first and second oblique surfaces. Mating tabs and slots defined along engaging surfaces of the components define a degree of travel therebetween and which facilitate either outward extension or inward collapsing in order to install and tauten or to remove an endless (looped) sanding sheet, such as typically associated with a wallboard or wood sanding operation.

A key component is pivotally supported at an interior location established between the upper and lower assembleable halves and includes a trigger component which is accessible through a lengthwise slot defined in the upper halve. A window is defined in an upwardly projecting inner rail associated with the lower assembleable and linearly displaceable halve, through which extends a body portion of the key between its inner pivotal mounting location and outer engageable trigger.

Upon being pivotally actuated in a first contracting direction, in which the trigger is grasped and rotated outwardly from the body along the linearly edge defined slot, a first inner bend location associated with the key body engages a first edge defining shoulder associated with the window to inwardly/linearly collapse the lower halve relative to the upper halve and so as to reduce a collectively defined outer circumference associated with the sanding block to permit lateral removal of an outer supported sanding belt. Reverse rotation of the trigger results in an outwardly bent edge defined at a generally opposite side of the trigger body engaging a second edge defining shoulder of the window, further rotation of the trigger to return it to the flush position relative to the sanding block body resulting in the respective halves expanding outwardly to the maximum displaced position to tension a replacement positioned sanding belt.

Other features associated with the present design include the exterior surfaces associated with the base and cover further exhibiting projecting scales, between which are defined vacuum withdrawal passageways communicating with the interior of the three-dimensional article via slots defined in the exterior surfaces. A vacuum attachment aperture defined in a side surface associated with the cover facilitates retrieval of accumulated particles resulting from a sanding operation.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Referring now to each of FIGS. 1-10, a sanding block article is illustrated at 10 according to a preferred embodiment of the present invention. As described previously, the present invention is an improvement over prior art sanding block designs, in that it provides a multi (oblique) surface article, key/trigger actuated, device which is capable of being quickly retracted in order to install or replace a sanding belt for a desired sanding operation. As will also be described in greater detail, the sanding block construction incorporates a number of aperture inlets and which, in cooperation with a vacuum attachment (see at 12 in FIG. 1), provide for vacuum removal of particles resulting from the sanding operation.

Figure 2:
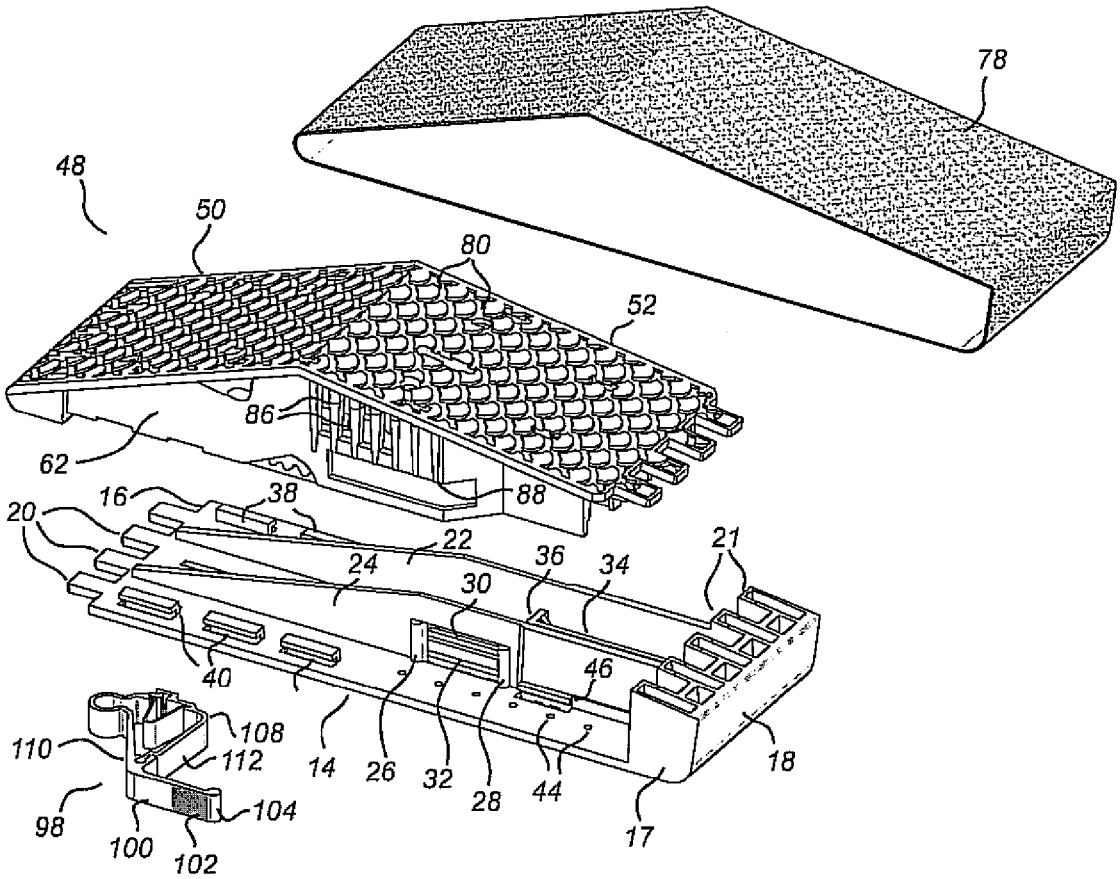
FIG. 2 is an exploded illustration of the sanding block showing the interengageable base and cover components defining the adhering surfaces for the endless sanding belt, as well as the pivotally supported key and trigger for selectively outwardly or inwardly displacing the components to selectively loosen or tauten the belt.
Figure 3:
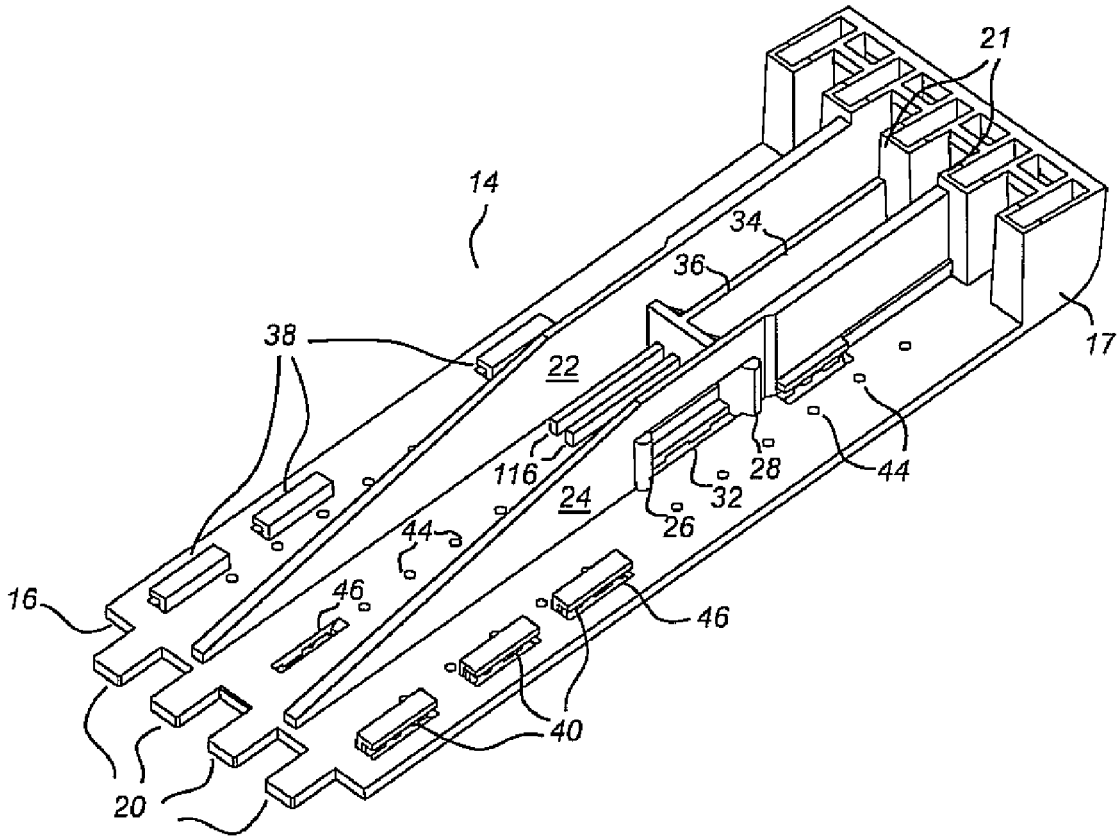
FIG. 3 is an enlarged isolated sectional perspective of the lower assembleable sanding block half or base.

As further depicted in each of FIGS. 2 and 3, a substantially elongated and planar shaped base is generally illustrated at 14 and includes a first end 16 and a second three-dimensional rounded end 18. The base 14 is constructed of a durable plasticized material and includes, at its first end 16, a plurality of laterally outwardly extending and end projecting support locations (also spaced apart guides) and as are shown at 20, as well as corresponding opposite end spaced apart support locations (or guides) 21 associated with its opposite and rounded end 18, these accessible along an inner widthwise extending pedestal portion 17 associated with the opposite end 18.

As is further shown, a pair of depthwise extending support ribs 22 and 24 extend in spaced apart and linear fashion between the first end 16 and the second end 18. The ribs 22 and 24 each ascend in a generally upwardly angled slope from an initial location proximate the first end 16 and, at substantial midpoint locations, level out at a maximum elevation and extend a remaining length until they contact the inner facing side of the pedestal portion 17.

Further defined within a selected rib 24 is a window which is further exhibited by a pair 26 and 28 of edge projecting shoulders along opposite and vertical spaced apart location and which, in combination with a pair of spaced apart upper 30 and lower 32 edges collectively define a rectangular shaped opening. A further intermediate linear extending and reduced height rib, see at 34, exhibits a cross tee end location 36, this providing inner reinforcing support between the larger ribs 22 and 24 as well as displaceable guiding support to the upper assembleable sanding block half.

Other features associated with the base 14 include individual pluralities of lengthwise positioned and spaced apart extending tabs 38 and 40 (see FIG. 2), these projecting in outwardly facing and outboard directions relative to the inwardly displaced support ribs 22 and 24, and along the inner face of the base 14. An opposite exterior defined face of the base 14 exhibits a plurality of textured or projecting scales, see as best depicted at 42 in end cutaway perspective of FIG. 7 between which are defined vacuum withdrawal passageways 44 communicating with the interior side of the base.

As will be further described, the flow through passageways cooperate with additional like passageways associated with the upper assembleable sanding block half in order to assist in interior removal of sanding particulate though the vacuum withdrawal attachment hose 12. Additional elongated apertures 46 (see FIG. 2 exploded view) can also extend through the thickness of the base 14, these typically corresponding to the placement and location of the reverse side projecting tabs 38 and 40 and resulting from material reshaped from the base during a suitable plastic forming process for creating the base.

Figure 4:
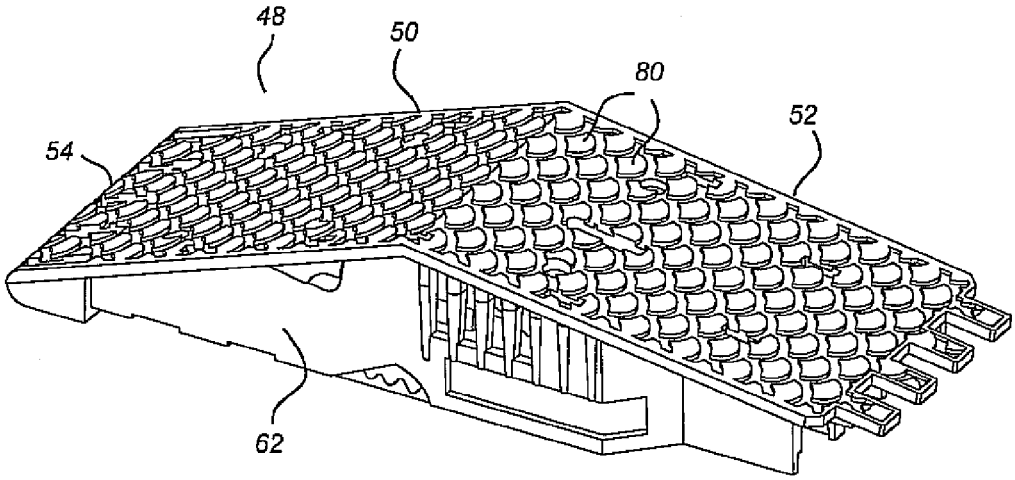
FIG. 4 is a corresponding and isolated sectional perspective of the upper sanding block half or cover.
Figure 6:
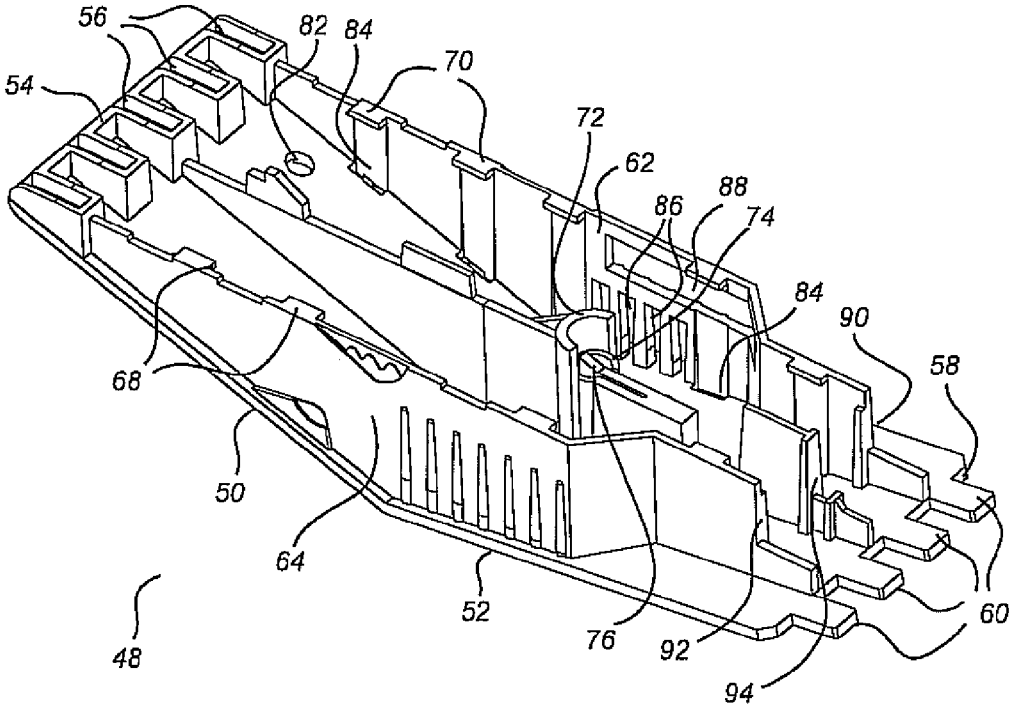
FIG. 6 is an inverted view of the upper assembleable body half or cover and which better illustrates the circular supporting location defined upon an inner and lengthwise extending ribs for seating a pivotally defining portion associated with the key.
Figure 6A:
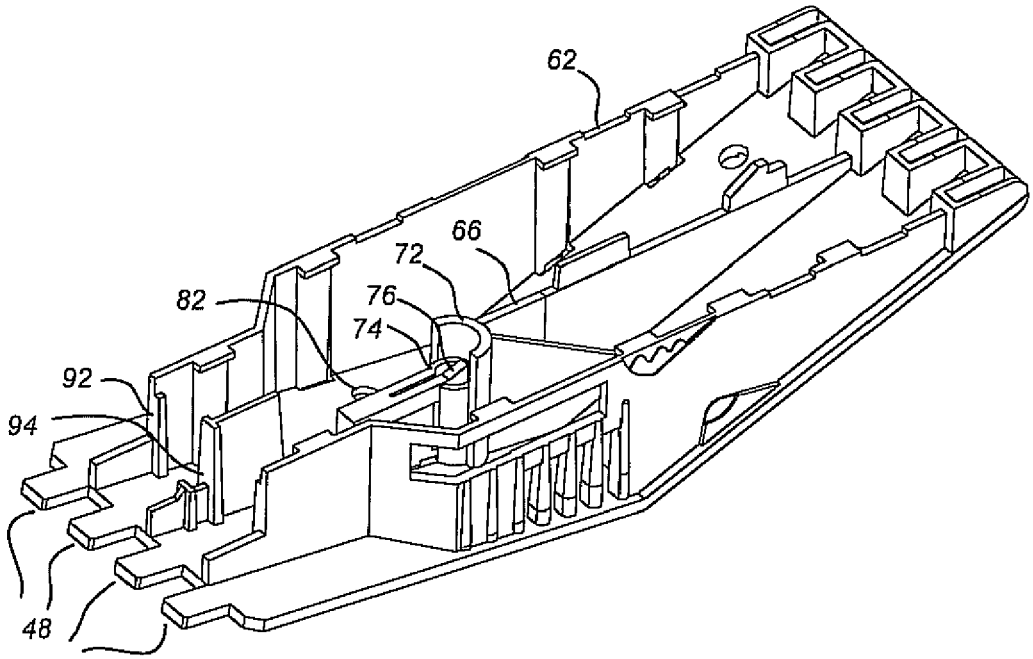
FIG. 6A is a further rotated and lengthwise cutaway of the cover in FIG. 6 and illustrating the circular and underside projecting location upon which the pivot seating location of the key is supported.
Figure 6B:
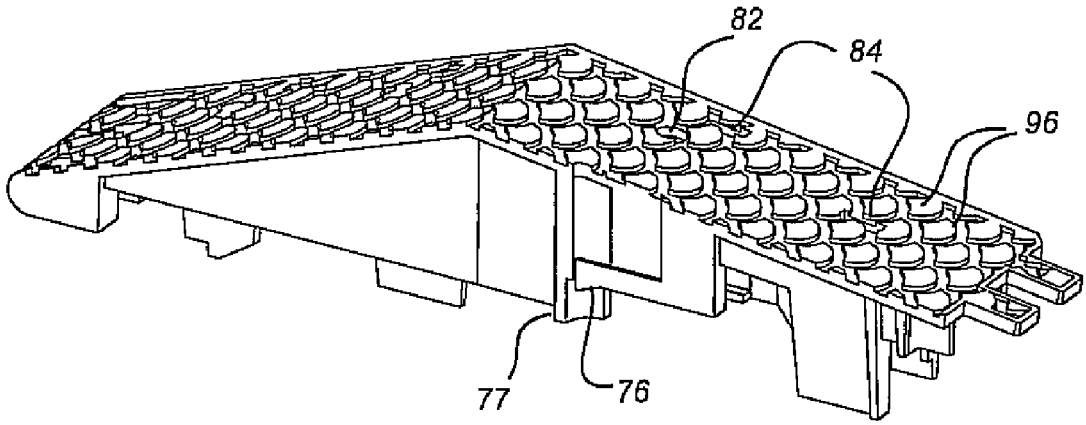
FIG. 6B is a further rotated view of the upper body depicted in a further lengthwise cutaway portion and better showing the scaled configuration of its exposed upper angled surfaces.
Figure 6C:
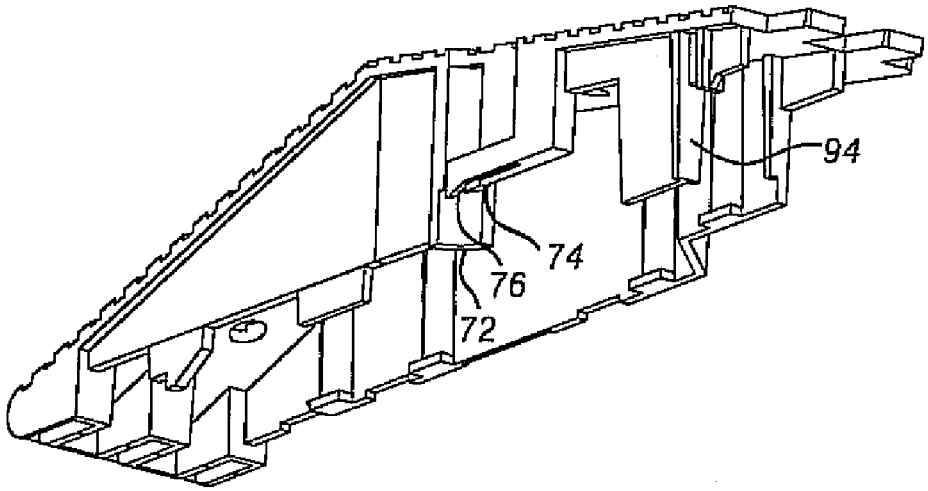
FIG. 6C is a succeeding and underside angled perspective of the upper body shown in FIG. 6B.

Referring again to FIGS. 1 and 2, in combination with FIGS. 4 and 6-6C, an upper assembleable sanding block half is generally depicted at 48 and includes a substantially elongated and planar shaped cover exhibiting first and second oblique extending surfaces 50 and 52. The cover 48 is, similar to the base 14, constructed of a durable plasticized material and includes, at its first end 54, a plurality of laterally extending and spaced apart support locations or guides 56 (FIG. 6).

Located along an opposite second end 58 of the cover are spaced apart support locations or guides 60, these similar to those shown at 20 in reference to the base 14. The cover 48 is also of a general overall length equivalent to the base 12 and so that, upon assembly, the inter-mating and laterally offset support portions established between the base and cover at each of first and second ends provide for a desired range of linear expansion/contraction.

As is further shown in the inverted exploded perspective of FIG. 6, a pair of outer and depthwise extending support walls 62 and 64 are provided, between which an inner support rib 66 extends lengthwise along the interior of the cover 48, in spaced apart and overlapping fashion relative to the support ribs 22 and 24 associated with the base 14. The cover 48, as with the base 14, further includes interengaging surfaces, upon which are defined a plurality of tabs 68 and 70 (see again FIG. 6).

Disposed at an intermediate location of the inner support rib 66 are a pair of coaxial and height offset support ring surfaces 72 and 74 with an upwardly angled end tab 76 associated with the lower positioned ring 74 collectively establishing a pivotal support location for receiving a pivotal key component as will be described. As shown, the angled end configuration 76 of the 76 extends above a level inner surface established by the recessed coaxial ring support 74 and, as will be subsequently explained in reference to the corresponding key, prevents the pivotal mounting end of said key from unseating.

Figure 1:
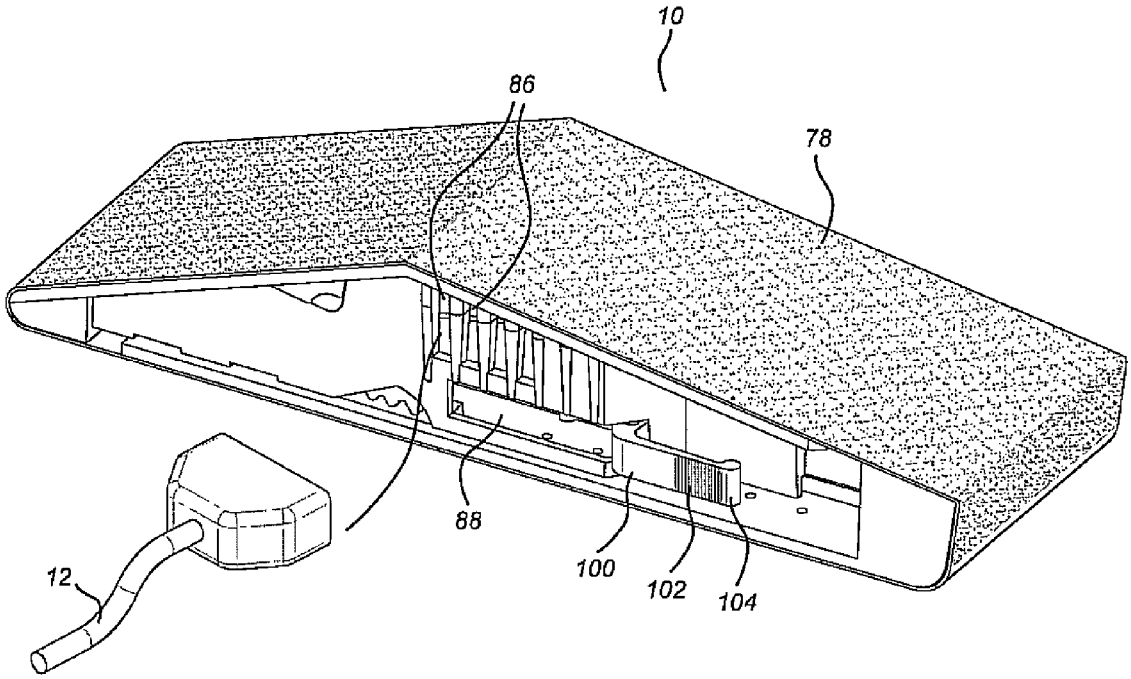
FIG. 1 is an assembled perspective illustration of the sanding block according to the present invention with upper and lower assembleable and linearly displaceable halves and exposed key displacing trigger, the block also illustrating a side exposed location for receiving a vacuum hose attachment.

Upon engagement with mating tabs 38 and 40 associated with the base, the tabs 68 and 70 assemble in a lengthwise traversable fashion in order that the base and cover collectively define a three-dimensional article for supporting thereupon a looped sanding belt 78 (see again FIG. 1). Reference is also made to the crosswise cutaway illustration of FIG. 7A, and which shows the nature in which the lengthwise traversable and sliding connection is established between the interengaging and mating tabs associated with the cover and base.

An opposite exterior defined face of the cover 48 exhibits a plurality of textured or projecting scales, see at 80 in FIGS. 2 and 4, between which are defined vacuum withdrawal passageways (circular holes 82 and lengthwise aperture 84). These collectively communicate with an interior of the base. Also defined in selected outer support wall 62 of the three-dimensionally defined cover 48 are a plurality of spaced side openings 86, these collectively defining a connecting port to which is secured the vacuum attachment 12. Also illustrated at 88 is a linear slot defined in selected outer wall 62 and, as will also be subsequently described, receives an extending trigger portion associated with the key actuating component.

Of further note, the outer walls 62 and 64 and inner rib support 66 of the cover 48 substantially terminate at stepped and vertical shoulder locations, see at 90, 92 and 94 in inwardly spaced proximity to its end 58 in order to seat the pedestal projecting location 17 associated with the base assembleable half 14 as best shown in FIG. 2. FIG. 7B further best illustrates the manner in which the opposing and aligning sets of tabs (see at 38 and 40 associated with the bottom half 14 and further at 68 and 70 associated with the top half 48) align during assembly of the sanding block assembly 10 and in order to facilitate the degree of linear displace-ability necessary for establishing an extensible/tensioned use position for supporting the exterior sanding belt loop 78 or a retracted/relaxed position for permitting ease of removal and replacement of a substitute belt.

Also similar to that shown at 80 in reference to the base 14, additional scales 96 are configured along the exterior of the upper/angled body 48 such that the scales extend around substantially the circumference of the assembled exterior of the sanding block. In this fashion, the recessed communicating channels associated with the scale pattern (see as best accentuated in FIGS. 6B and 7B) function in combination with the block interior vacuum passageways (again round apertures 82 and linear cutout slot apertures 84 in the top half 48 in combination with additional round apertures 44 and linear slot apertures 46 in the base 14) and the vacuum withdrawal structure (side apertures 86 and vacuum conduit and plug 12) in order to remove accumulated dust and particles resulting from a sanding operation.

Figure 5:
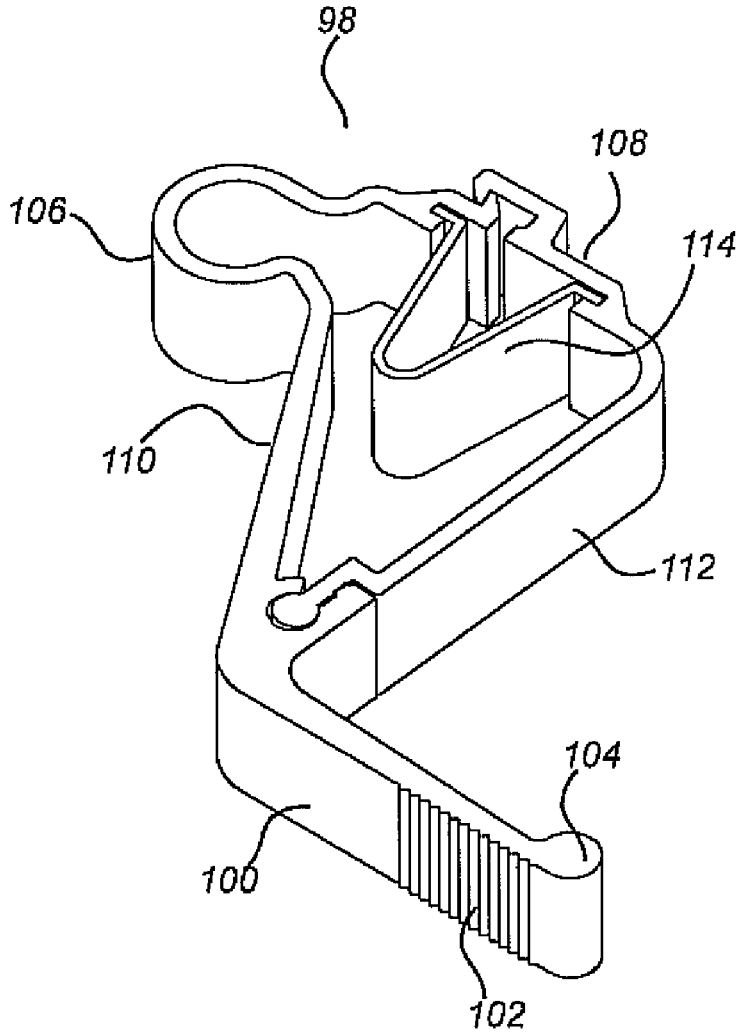
FIG. 5 is an enlarged isolated sectional perspective of the key and trigger portion.

With reference to FIGS. 2 and 5, a key 98 is provided for being pivotally seated and supported at an interior location between the lower and upper assembleable halves 14 and 48. The key exhibits a generally three dimensional configuration with flattened top and bottom surfaces includes and includes an elongated shaped and integrally formed trigger component 100 with an exterior knurled surface configuration 102 and a rounded, slightly enlarged end grasping location 104. An inner pivotal mounting end is exhibited by a substantially circular/rounded and interiorly open portion 106 which is installed upon the coaxial and height offset support ring surfaces 72 and 74 in a pivoting permissible fashion while being prevented from unseating via the angled end tab 76 associated with the lower positioned ring 74.

An interconnecting body exhibits a substantially or "pseudo" triangular shape and includes sides 108, 110 and 112. A further "V" shaped clip portion 114 is mounted within inner surface locations associated with selected side 108 and so that the clip 114 extends within a corresponding and generally triangular shaped open interior profile of the key.

In use, the clip 114 provides additional biasing and supporting aspects to the key 98 during mounting and pivotal displacement (see FIG. 7 et seq.) upon and along additional support ridges 116 (see FIG. 3) associated with the base 14. As further best depicted in cutaway of FIG. 7, upon installation the key body extends through the window (top and bottom surfaces 30 and 32 and side shoulders 26 and 28) and the trigger 100 with grasping end protuberance 104 is arranged in a generally flush and accessible fashion through the elongated slot (see again interconnected inner and perimeter defining surfaces 88) defined in the upper body half 48.

Additional to the various described linear and end cutaway assembled views of FIGS. 6A-6C, FIGS. 7 and 7A present a pair of rotated and underside facing views depicting the direction of pivoting of the key and trigger (see arrow 118 in FIG. 7A) along with an illustration in phantom of the range of inwardly collapsing displacement of the offset and opposing/aligning pluralities of guides associated with the top and bottom halves. This is further referenced in FIG. 7A by additional and linear bi-directional arrow 120 which references the relative linear displacement of bottom half established end guides and between outer expanded positions (again at 21) and inner collapsed positions (at 21' in phantom). As previously indicated, FIG. 7B is a further rotated and end cutaway view of the sanding block and better illustrating the guiding relationship established by the linear inter-engaging and displaceably supporting lengthwise projecting tabs 38 and 40 associated with the bottom assembleable half 14 and which seat, restrain and linearly support opposing and outwardly positioned tabs 68 and 70 associated with the underside of the top half 48.

Figure 7:
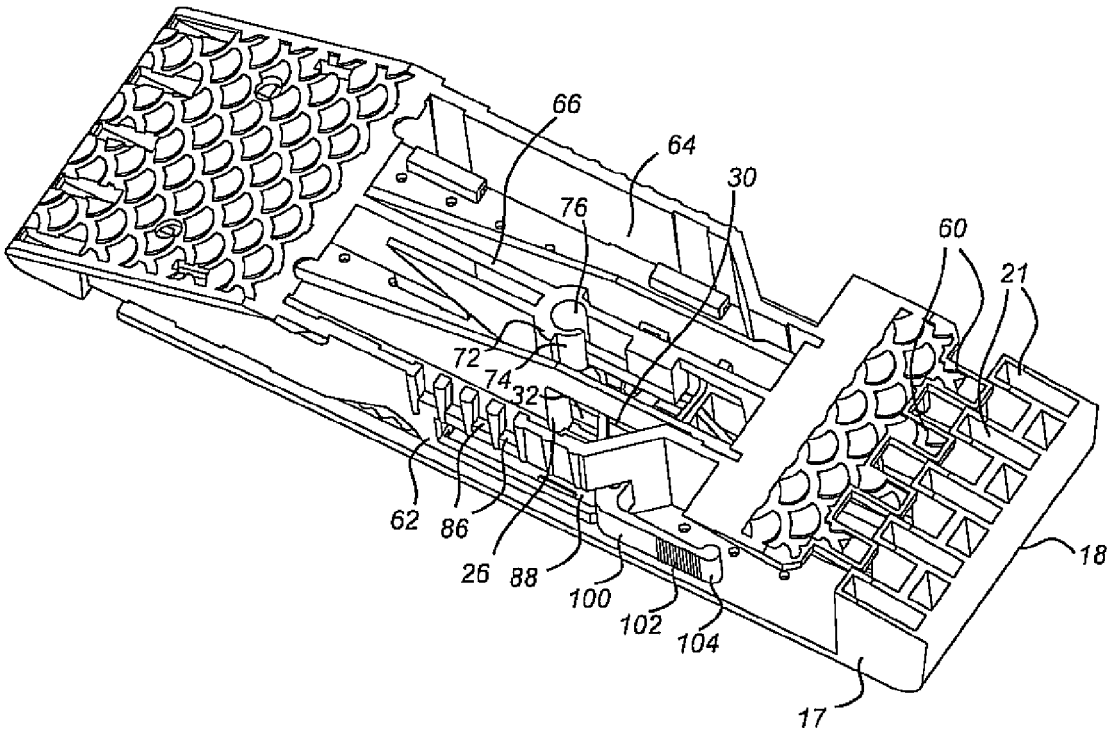
FIG. 7 is an underside facing perspective of an assembled sanding block, with the upper sanding block half depicted in substantially cutaway exposed fashion for purposes of illustration, and depicting the key installed and shown in an expanded position.
Figure 7A:
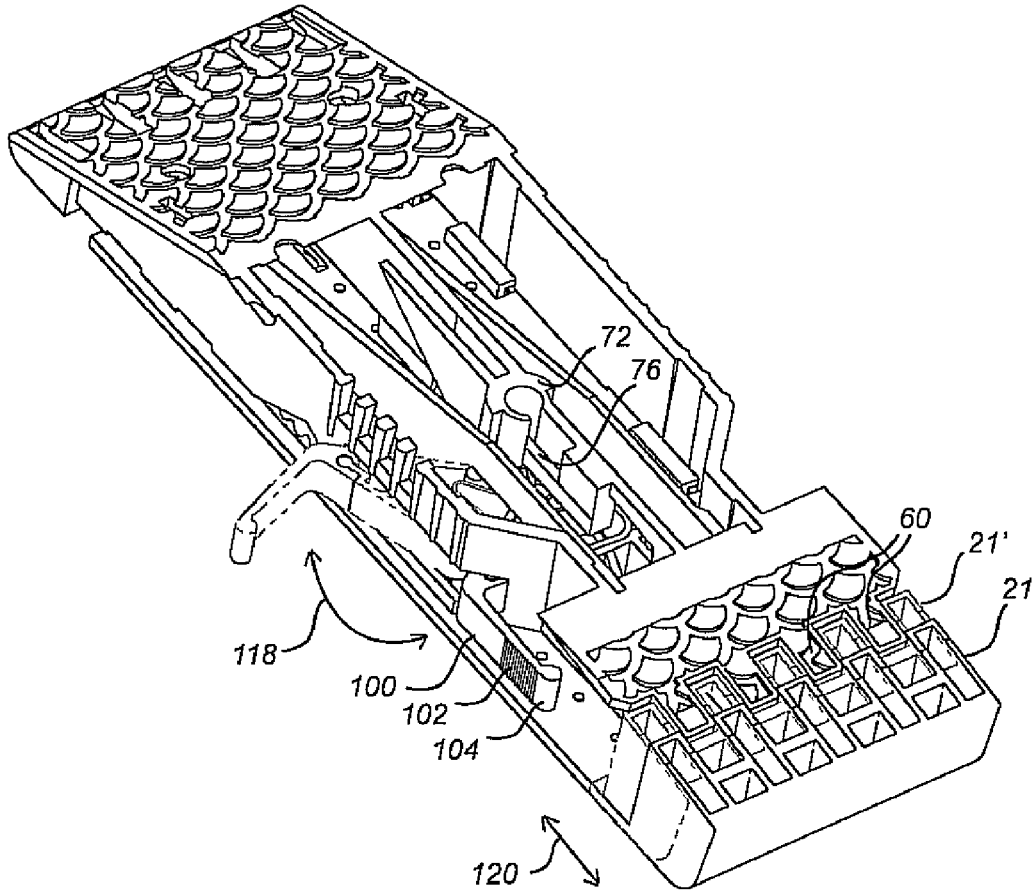
FIG. 7A is a further rotated underside facing view similar to FIG. 7 and depicting the direction of pivoting of the key and trigger along with an illustration in phantom of the range of inwardly collapsing displacement of the offset and opposing/aligning pluralities of guides associated with the top and bottom halves.
Figure 7B:
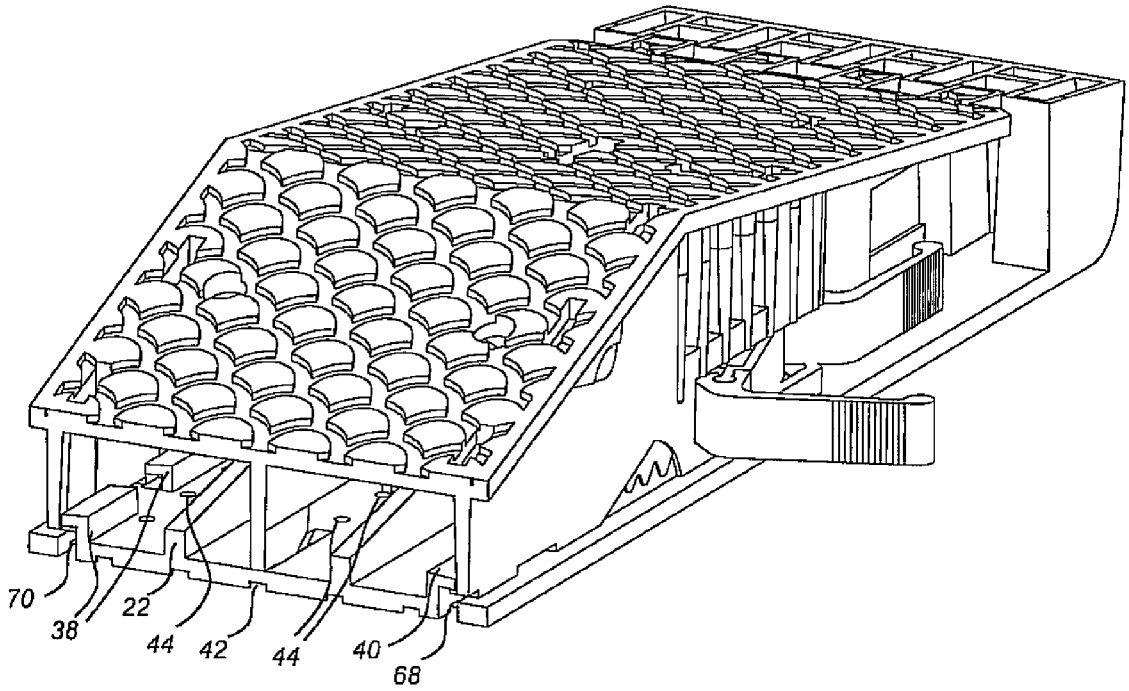
FIG. 7B is a further rotated and end cutaway view of the sanding block and better illustrating the guiding relationship established by the lengthwise projecting tabs associated with the bottom assembleable half and which seat and linearly support opposing tabs associated with the underside of the top half.
Figure 8:
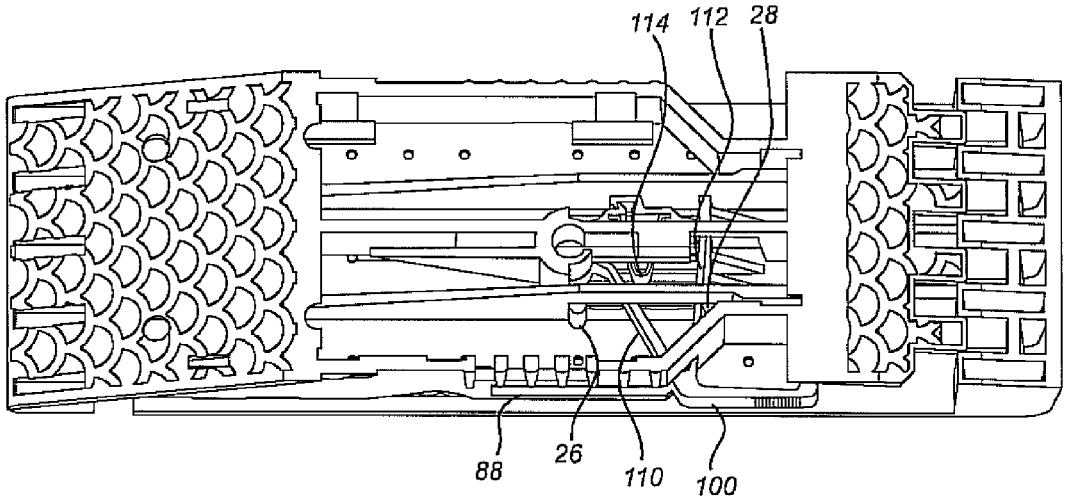
FIG. 8 is an illustration similar to that shown in FIG. 7 and in which the assembled halves of the sanding block are depicted in a first expanded relationship;\
Figure 9:
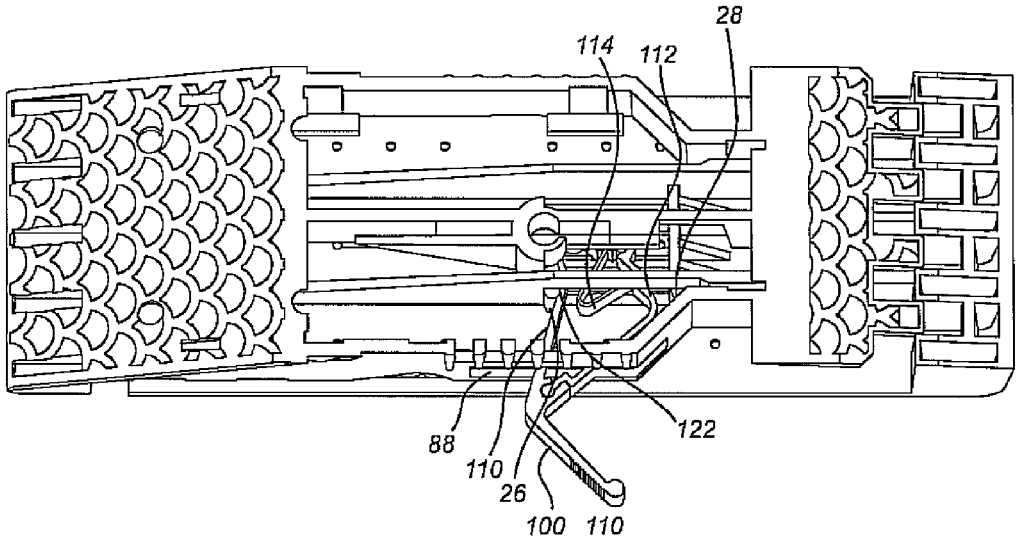
FIG. 9 is a succeeding illustration to FIG. 8 and in which the trigger is grasped and rotated outwardly from the body along the linearly edge defined slot, with a first inner bend location associated with the key body engaging a first edge defining shoulder associated with the window defined in an upwardly projecting inner rail associated with the lower assembleable and linearly displaceable halve to inwardly/linearly collapse the lower halve relative to the upper halve.

Proceeding to FIG. 8, a generally exposed cutaway illustration is shown similar to that shown in FIG. 7 and in which the assembled halves 14 and 48 establishing the sanding block are depicted in a first expanded relationship. FIG. 9 is a succeeding illustration to FIG. 8 and in which the trigger 100 is grasped and rotated outwardly from the body along the linearly edge defined slot 88.

Figure 10:
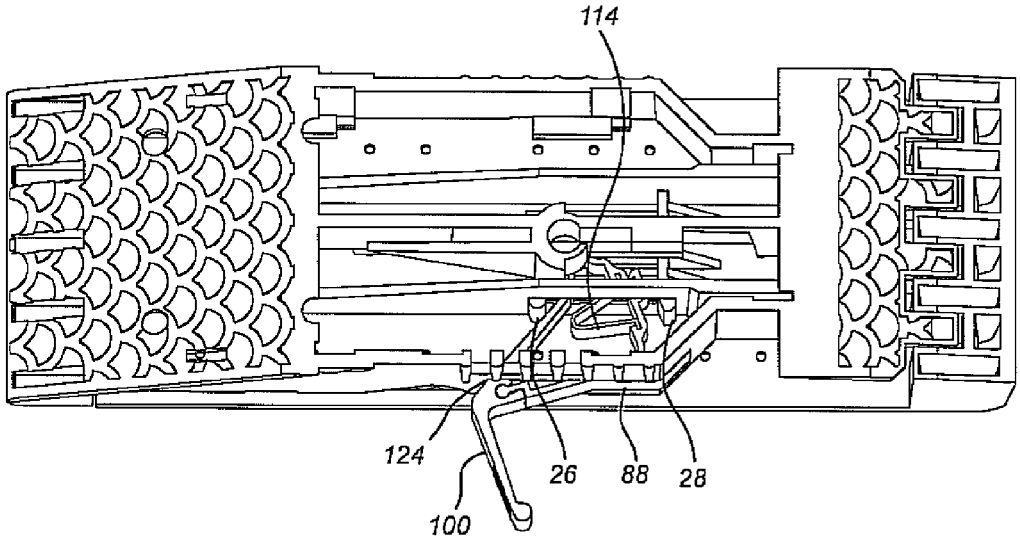
FIG. 10 is a further succeeding illustration in which key and trigger are pivoted into engagement with an end wall associated with the edge defined slot in the top body half, corresponding to a fully linearly inwardly and collapsed position established between the assembled body halves.

A first inner bend location, see at 122 associated with side 110 of the key body engages the first edge defining shoulder 26 associated with the window defined in the upwardly projecting inner rail 24 of the base 14 (or lower assembleable and linearly displaceable halve) and in order to inwardly/linearly collapse the lower halve 14 relative to the upper halve 48. FIG. 10 is a further succeeding illustration in which key 98 and trigger 100 are pivoted into engagement with an end wall 124 associated with the edge defined slot 88 in the top body half 48. This corresponds to a fully linearly inwardly and collapsed position established between the assembled body halves (see again displacement range 120 in FIG. 7A).

Accordingly, and in operation, the trigger 100 is grasped and rotated outwardly from the body along the linearly edged and rectangular defined slot 88, to inwardly/linearly collapse the lower halve relative to the upper halve and so as to reduce a collectively defined outer circumference associated with the sanding block to permit lateral removal of an outer supported sanding belt. Reverse rotation of the trigger results in an outwardly bent edge (see as best shown at 126 in FIG. 9) defined at a generally opposite side of the trigger body engaging the second edge defining shoulder 28 of the inner defined window, with further reverse rotation of the trigger (opposite directional arrow 118 in FIG. 7A) returning it to the flush position (FIGS. 7 and 8) relative to the sanding block body, resulting in the respective halves 14 and 48 expanding outwardly to the maximum displaced position to tension a replacement positioned sanding belt 78.

As previously discussed, other features associated with the present design again include the exterior surfaces associated with the base and cover further exhibiting projecting scales, between which are defined vacuum withdrawal passageways communicating with the interior of the three-dimensional article via slots defined in the exterior surfaces. A vacuum attachment aperture defined in a side surface associated with the cover facilitates retrieval of accumulated particles resulting from a sanding operation.

Upon assembly, the three-dimensional defining article exhibits oblique interconnected and belt supporting surfaces (see again at 50 and 52 for upper assembleable half 48) and in combination with a generally planar exterior surface associated with the bottom half 14, support the looped belt 78. In this fashion, the scaled and recess defining nature of the exterior surfaces (at 80 for bottom half 14 and at 96 for upper half 48), combined with the plurality of communicating passageways with the open interior of the assembled article 10 and the attachable vacuum conduit 12, provide for effective evacuation of wood or wallboard particles resulting from a given sanding operation. It is contemplated that the sanding block article can operate either with or without the vacuum attachment, however provision of the same provides the additional benefit of substantially dust-free sanding.

Having described my invention, other and additional preferred embodiments will become apparent to those skilled in the art to which it pertains, and without deviating from the scope of the appended claims.

I claim:

1. An expansible sanding block for supporting an exteriorly mounted looped sanding belt, comprising:

an elongate and substantially planar shaped base exhibiting a bottom extending belt supporting surface;

a cover exhibiting first and second oblique extending belt supporting surfaces establishing a peaked configuration, each of said base and cover exhibiting a first curved end with internally accessible support locations as well as a second end exhibiting externally facing and offset support locations which are engageable with said internally accessible support locations in order that said base and cover can be inter-engaged in a mutually linearly extensible fashion so that an overall length of said cover overlaps said base to collectively define a three-dimensional article for supporting the sanding belt;

said base and cover each further comprising a plurality of lengthwise extending and mating tabs and slots defining a range of lengthwise inter-displacement between said base and cover, each of said base and cover further exhibiting linear extending and depthwise projecting support ribs; and a pivotally supported key extending between abutting locations of said base and cover and communicable with a window defined in an upwardly extending interior support rail associated with said base, a trigger portion extending from said key and extending through an elongated slot defined in said cover in an exposed and accessible fashion, said trigger being displaced in a first pivotal direction to engage a first shoulder associated with said window to lengthwise retract said cover in a first extensible direction relative said base and to loosen underside support of the belt, said trigger displacing in a second and opposite pivotal direction to engage a second shoulder associated with said window and to reverse displace and extend said cover relative said base to lengthwise extend and to tauten the belt.

2. The sanding block as described in claim 1, said offset support locations further comprising each of said base and cover exhibiting lengthwise projecting and spaced apart guides associated with said interengaging planar surfaces, opposing edges of said base and cover further comprising guide receiving recesses which define a range of lengthwise displacement established between said base and cover.

3. The sanding block as described in claim 1, said key exhibiting a generally three dimensional and pseudo triangular profile with flattened top and bottom surfaces.

4. The sanding block as described in claim 3, further comprising an inner pivotal mounting end of said key exhibited by a substantially circular/rounded and interiorly open portion which is installed upon coaxial and height offset support ring surfaces associated with an underside of said cover, an angled tab extending above an inner recessed coaxial ring support surface to prevent said pivotal mounting end of said key from unseating.

5. The sanding block as described in claim 1, said trigger defining an integrally formed and elongate extending portion and having an exterior knurled surface configuration and a rounded, slightly enlarged end grasping location.

6. The sanding block as described in claim 3, said key further comprising a "V" shaped clip portion mounted within inner surface locations associated with at least one selected side of said triangular shaped body and so that said clip extends within a corresponding and generally triangular shaped open interior profile of the key, said clip providing additional support during mounting and pivotal displacement upon and along additional support ridges associated with said base.

7. The sanding block as described in claim 1, at least one of said exterior surfaces associated with said base and cover further exhibiting projecting scales, between which are defined vacuum withdrawal passageways communicating with said interior of said three-dimensional article via slots defined in said exterior surfaces.

8. The sanding block as described in claim 7, further comprising a vacuum attachment aperture defined in a side surface associated with said cover and facilitating retrieval of accumulated particles resulting from a sanding operation.

9. The sanding block as described in claim 1, said base, cover and trigger exhibiting a specified shape and size and being constructed of a durable plasticized material.

10. A sanding block for supporting an exteriorly mounted looped sanding belt, comprising:

a substantially elongated and planar shaped base having a first end and a second end and establishing a bottom extending belt supporting surface;

a substantially elongated and planar shaped cover exhibiting at least first and second oblique extending and belt supporting surfaces and having an overall length equivalent to said base, each of said base and cover further comprising interengaging surfaces upon which are defined a plurality of mating tabs and slots and by which, upon engagement, establishes substantially overlapping lengths which collectively define a three-dimensional article exhibiting a range of lengthwise displacement and for supporting thereupon the looped sanding belt;

said base and cover each further comprising a plurality of lengthwise extending and mating tabs and slots defining a range of lengthwise inter-displacement established between said base and cover, each of said base and cover further exhibiting depthwise projecting support ribs;

a key extending between abutting locations established within an open interior of said assembled base and cover, said key exhibiting a generally three dimensional and pseudo triangular profile with flattened top and bottom surfaces, an inner pivotal mounting end of said key exhibited by a substantially circular/rounded and interiorly open portion which is installed upon coaxial and height offset support ring surfaces associated with an underside of said cover, an angled tab extending above an inner recessed coaxial ring support surface to prevent said pivotal mounting end of said key from unseating, a linear trigger portion integrally formed and extending from said key; and said key extending through a window defined in an upwardly extending interior support rail associated with said base, said trigger portion extending through an elongated slot defined in said cover in an exposed and accessible fashion, said trigger being displaced in a first pivotal direction to engage a first shoulder associated with said window to lengthwise retract said cover in a first extensible direction relative said base and to loosen underside support of the belt, said trigger displacing in a second and opposite pivotal direction to engage a second shoulder associated with said window and to reverse displace said cover relative said base to lengthwise extend and to tauten the belt.

11. The sanding block as described in claim 10, said key further comprising a "V" shaped clip portion mounted within inner surface locations associated with at least one selected side of said triangular shaped body and so that said clip extends within a corresponding and generally triangular shaped open interior profile of the key, said clip providing additional support during mounting and pivotal displacement upon and along additional support ridges associated with said base.

12. The sanding block as described in claim 10, at least one of said exterior surfaces associated with said base and cover further exhibiting projecting scales, between which are defined vacuum withdrawal passageways communicating with said interior of said three-dimensional article via slots defined in said exterior surfaces.

13. The sanding block as described in claim 12, further comprising a vacuum attachment aperture defined in a side surface associated with said cover and facilitating retrieval of accumulated particles resulting from a sanding operation.

14. The sanding block as described in claim 10, said base, cover and trigger exhibiting a specified shape and size and being constructed of a durable plasticized material.

15. An expansible sanding block for supporting an exteriorly mounted looped sanding belt, comprising:

an elongate and substantially planar shaped base exhibiting a bottom extending belt supporting surface;

a cover exhibiting first and second oblique extending belt supporting surfaces establishing a peaked configuration, each of said base and cover exhibiting a first curved end with internally accessible support locations as well as a second end exhibiting externally facing and offset support locations which are engageable with said internally accessible support locations in order that said base and cover can be inter-engaged in a mutually linearly extensible fashion so that an overall length of said cover overlaps said base to collectively define a three-dimensional article for supporting the sanding belt;

said base and cover each further comprising a plurality of lengthwise extending and mating tabs and slots defining a range of lengthwise inter-displacement established between said base and cover, each of said base and cover further exhibiting depthwise projecting support ribs; and a pivotally supported key extending between abutting locations of said base and cover and terminating in an end gripping trigger which is accessible from an exterior of said assembled article, said trigger being displaced in a first pivotal direction to lengthwise retract said cover in a first extensible direction relative said base and to loosen underside support of the belt, said trigger displacing in a second and opposite pivotal direction to reverse displace and extend said cover relative said base to lengthwise extend and to tauten the belt.

* * * * *